US006775909B2

(12) United States Patent
Jönsson et al.

(10) Patent No.: US 6,775,909 B2
(45) Date of Patent: Aug. 17, 2004

(54) LINING DEVICE FOR A PLATE HEAT EXCHANGER

(75) Inventors: Mats Jönsson, Lomma (SE); Anders Andersson, Stehag (SE); Inge Svensson, Genarp (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 10/471,396

(22) PCT Filed: Apr. 22, 2002

(86) PCT No.: PCT/SE02/00779

§ 371 (c)(1),
(2), (4) Date: Jan. 13, 2004

(87) PCT Pub. No.: WO02/088615

PCT Pub. Date: Nov. 7, 2002

(65) Prior Publication Data

US 2004/0112580 A1 Jun. 17, 2004

(30) Foreign Application Priority Data

Apr. 24, 2001 (SE) ..... 010426

(51) Int. Cl.[7] ..... F28F 3/00

(52) U.S. Cl. ..... 29/890.03; 29/890.054; 165/167; 165/178

(58) Field of Search ..... 165/166, 167, 165/178; 29/890.03, 890.054

(56) References Cited

U.S. PATENT DOCUMENTS 4,482,089 A 11/1984 Lindahl et al.
4,595,208 A * 6/1986 Jonsson et al. ..... 165/167
4,699,212 A 10/1987 Andersson et al.
4,750,555 A * 6/1988 Ahl et al. ..... 165/168
4,848,451 A 7/1989 Jonsson et al.
5,033,543 A 7/1991 Nilsson et al.

FOREIGN PATENT DOCUMENTS

| | | | |
|---|---|---|---|
| DE | 2357059 A1 | * | 5/1975 |
| GB | 1041805 A | * | 9/1966 |
| GB | 2 000 267 | | 1/1979 |
| JP | 61154723 A | * | 7/1986 |
| JP | 11101593 A | * | 4/1999 |
| SE | 456 856 | | 11/1988 |
| WO | WO 8800682 A | * | 1/1988 |

* cited by examiner

*Primary Examiner*—Leonard R. Leo
(74) *Attorney, Agent, or Firm*—Fish & RIchardson P.C.

(57) ABSTRACT

The invention refers to a lining device (15) for a plate heat exchanger, a plate heat exchanger, and a method for manufacturing a plate heat exchanger with a package of heat transfer plates and an end plate (5), which has at least one porthole. The lining device includes a first part (16) and a second part (17). Each of these parts is manufactured of a sheet metal and has a substantially cylindrical pipe portion (16*a*, 17*a*) and an abutment portion (16*b*, 17*b*). The pipe portion of the first part is introducible in the porthole and the pipe portion of the second part is introducible in the porthole into the pipe portion of the first part in such a way that an area (19) is formed where the pipe portions overlap each other. The parts are connected to each other by a weld joint (18). The material thickness of the first part is greater than the material thickness of the second part at least at the overlapping area.

15 Claims, 3 Drawing Sheets

LINING DEVICE FOR A PLATE HEAT EXCHANGER

BACKGROUND OF THE INVENTION AND PRIOR ART

The present invention refers to a lining device for a plate heat exchanger according to the preamble of claim 1, a plate heat exchanger according to the preamble of claim 8, and a method for manufacturing a plate heat exchanger including a package with heat transfer plates and an end plate, which has an outer side and an inner side facing the plate package and at least a porthole.

It is known to provide the portholes of the end plates of a plate heat exchanger with a lining. According to a conventional method, a starting material is manufactured, which consists of a deep-drawn pipe portion and a flange portion extending around the pipe portion and substantially radially outwardly from the pipe portion at its one end. The other end of the pipe portion is introduced into and through the porthole of the end plate so that the flange portion abuts one side of the end plate. Thereafter, the other end of the pipe portion is bent outwardly so that it forms a flange abutting the other side of the end plate. Such a lining has certain disadvantages. The manufacturing of the starting material is performed in several steps with intermediate heat treatment. During certain conditions, problems can occur with the quality of the bent flange due to formation of cracks. The mounting of the lining is performed in several steps.

SE-B-456 856 discloses a lining for a porthole of a plate heat exchanger. The document discloses two embodiments. The first embodiment, which is described most closely, corresponds to the conventional technique described above. The second embodiment refers to a lining divided in two parts with a first part and a second part. The first part is manufactured of a sheet metal and has a substantially cylindrical pipe portion and a flange portion extending outwardly from the pipe portion. The second part is also manufactured of a sheet metal and has a substantially cylindrical pipe portion and a flange portion extending outwardly from the pipe portion. The pipe portions are introduced in the porthole so that an area is formed where said pipe portions overlap each other. The pipe portions are connected to each other by welding but it does not appear how the weld joint extends.

U.S. Pat. No. 4,482,089 also discloses different embodiments of linings for a porthole of a plate heat exchanger. Also in this case, one embodiment corresponds to the conventional technique described above. Another embodiment refers to a lining manufactured of a pipe portion, which is introducible in a porthole. A flange is welded at each end of the pipe portion.

SUMMARY OF THE INVENTION

The object of the present invention is to overcome the problems mentioned above and to provide an improved lining device or a porthole of an end plate. In particular, it is aimed at a lining device which may be manufactured in an easy manner and which has an improved quality.

This object is obtained by the lining device initially defined, which is characterised in that the material thickness of the first part is larger than the material thickness of the second part at least at said overlapping area.

Since no deformation of the material takes place in the two parts during the mounting of such a lining device, the risk of formation of cracks of the inner abutment portion is substantially reduced.

Since the material thickness of one part is larger than the material thickness of the other part at least at said overlapping, i.e. the material thickness of at least the one pipe portion is larger than of the other pipe portion, the risk of contamination of the material in the proximity of the weld joint and in the transition between the end plates, which usually is manufactured of carbon steel, and the two parts is eliminated.

Furthermore, such a first part, which has a larger material thickness than the second part, permits that the second part during the welding is pressed against the first part so that possible air, and thus oxygen gas, between the parts is forced away. Consequently, the need of so called root gas, i.e. the supply of an inert gas, for instance argon, for displacing oxygen gas from this welding area is eliminated.

Each of the two parts may be manufactured in one single step of manufacturing without any intermediate heat treatment. The time for the mounting of the lining device to the end plate is very short and the weld joint may advantageously be applied in an automatic manner.

According to an embodiment of the invention, the sheet metal of the first part has a thickness, which is larger than 1,5 mm at least at said overlapping area. Such a thickness is sufficient for preventing contamination of the material and for resisting the forces applied in connection with the above-mentioned pressing of the parts against each other.

According to a further embodiment of the invention, the weld joint extends around substantially the whole pipe portion of the first part. Furthermore, the pipe portion of the second part may have a first end, which is introducible in the pipe portion of the first part, wherein the weld joint is applied at said first end.

According to a further embodiment of the invention, the abutment portion of one of the first part and the second part is arranged to form an outer abutment portion and to abut the outer side of the end plate, and the abutment portion of one of the second part and the first part is arranged to form an inner abutment portion and to abut the inner side of the end plate, wherein the material thickness of the outer abutment portion is larger than the material thickness of the inner abutment portion. The outer abutment portion may then have an outer side, which faces away from the plate package and which includes at least one depression, for instance one or several grooves, for receiving a sealing element between said outer side and a pipe connection, wherein the sealing element may be pressed against said outer side in a secure and reliable manner. Advantageously, the abutment portion of the first part is shaped as a flange portion, which extends around the pipe portion and substantially radially outwardly from the pipe portion, and the abutment portion of the second part is shaped as a flange portion, which extends around the pipe portion and substantially radially outwardly from the pipe portion.

According to a further embodiment of the invention, the pipe portion of the first part is introducible into said porthole from the outer side of the end plate and the pipe portion of the second part is introducible in said porthole from the inner side of the end plate. Such an embodiment is advantageous and permits the manufacturing of the first, outer part in one single piece of material with a relatively large material thickness and the second inner part in one single other piece of material with a relatively small material thickness.

The object is also obtained by the plate heat exchanger initially defined, which is characterised in that the material thickness of the first part is larger than the material thickness of the second part at least at said overlapping area.

Furthermore, the object is obtained by the initially defined method, which includes the steps of:

providing a first part, which is manufactured of a sheet metal with a material thickness and which has a substantially cylindrical pipe portion and an abutment portion, providing a second part, which is manufactured of a sheet metal with a material thickness and which has a substantially cylindrical pipe portion and an abutment portion, introducing the pipe portion of the first part in said porthole, introducing the pipe portion of the second part in said porthole in the pipe portion of the first part in such a manner that an area is formed where said pipe portions overlap each other, wherein the material thickness of the first part is larger than the material thickness of the second part at least in said overlapping area, and p1 connecting the pipe portion of the second part to the pipe portion of the first part by the application of a weld joint.

Preferred embodiments of the method are defined in claims 12 to 15.

BRIEF DESCRIPTION OF THE DRAWINGS

The present invention is now to be explained more closely by means of a description of various embodiments, disclosed by way of example, and with reference to the drawings attached.

DETAILED DESCRIPTION OF DIFFERENT EMBODIMENTS OF THE INVENTION

Figure 1:
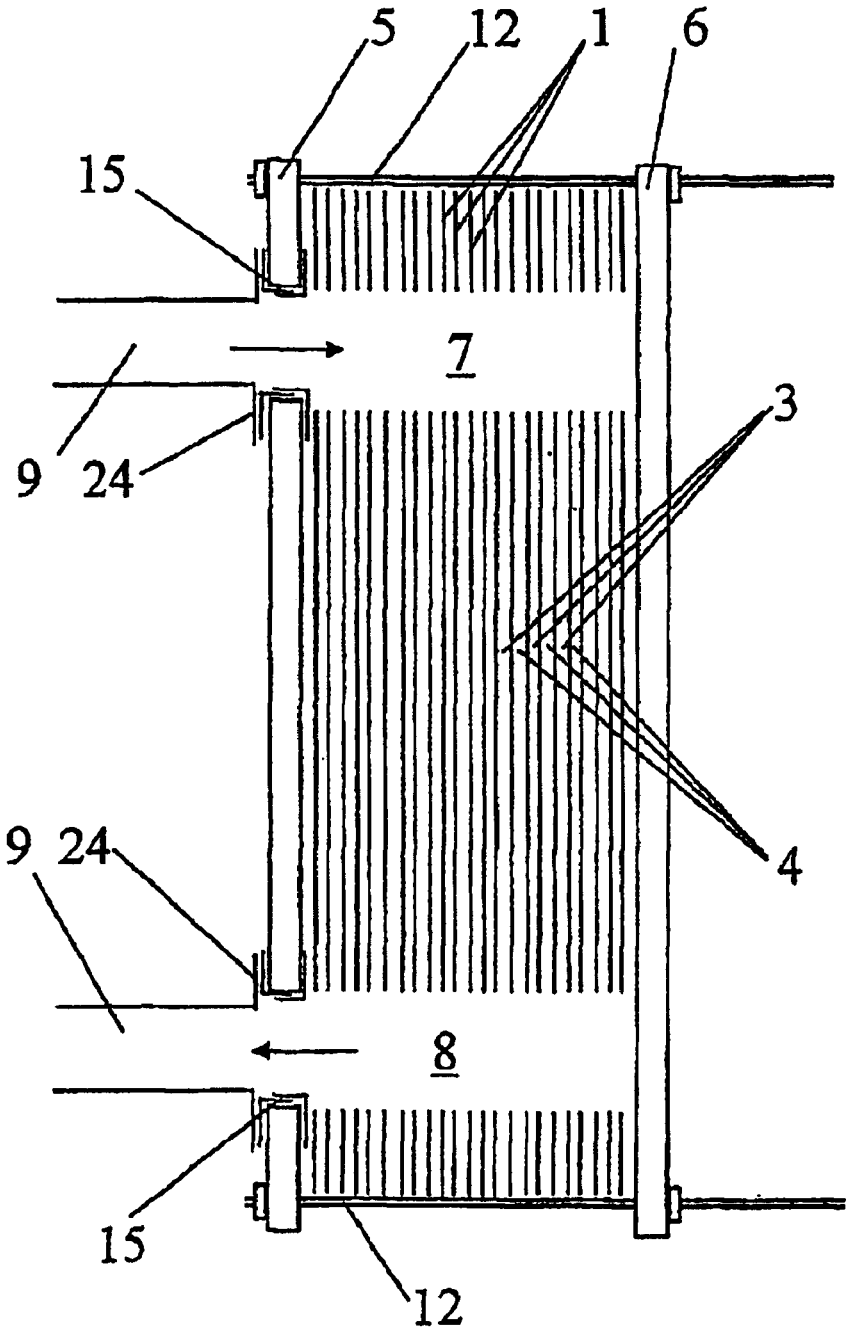
FIG. 1 discloses schematically a sectional view of a plate heat exchanger.

FIG. 1 discloses a plate heat exchanger according to a first embodiment of the invention. The plate heat exchanger includes a number of heat transfer plates 1, which form a plate package. The heat transfer plates 1 are pressed to such a shape that when they are arranged beside each other to said plate package, a plate interspace is formed between each pair of plates 1. The plate interspaces are arranged to form first passages 3 for a first fluid and second passages 4 for a second fluid. The first passages 3 are separated from the second passages 4. The plate heat exchanger includes also two end plates 5 and 6, between which the plate package is provided.

Furthermore, the plate heat exchanger includes four port channels 7, 8, two of which appear from FIG. 1. Each port channel 7, 8 extends through all plates 1 and at least one of the end plates 5, 6. Two of the port channels 7, 8 communicate with the first passages 3 and the two other port channels communicate with the second passages 4. It is to be noted that the plate heat exchanger according to the invention also may be of a type which has another number of port channels 7, 8, for instance 2 or 6 port channels and/or another number of passages 3, 4 for heat transfer fluids.

Each port channel 7, 8 is formed of an opening or a porthole in each plate 1 and one of the end plates 5. The portholes are preferably but not necessarily circular seen in the direction of the port channel 7, 8. Each port channel 7, 8 connects to a pipe 9 which extends from the plate heat exchanger. More precisely, the port channel 7 forms a first inlet channel, which is arranged to transport the first fluid to the first passages 3, and the port channel 8 forms a first outlet channel, which is arranged to transport the first fluid out of the plate heat exchanger from the first passages 3. The two other port channels form in the same way a second inlet channel, which is arranged to transport the second fluid to the second passages 4, and a second outlet channel, which is arranged to transport the second fluid out of the plate heat exchanger from the second passages 4.

In the plate heat exchanger disclosed in FIG. 1, the plates 1 are pressed against each other between the two end plates 5 and 6 by means of bolts 12 extending through the plates 1 and the end plates 5, 6. The plate heat exchanger may however also be kept together by other members than through-going bolts, for instance elongated elements tightened around the plate package and the end plates 5, 6. Gaskets (not disclosed) may then be provided between the plates 1 in order to separate said passages 3 and 4 from each other.

Figure 2:
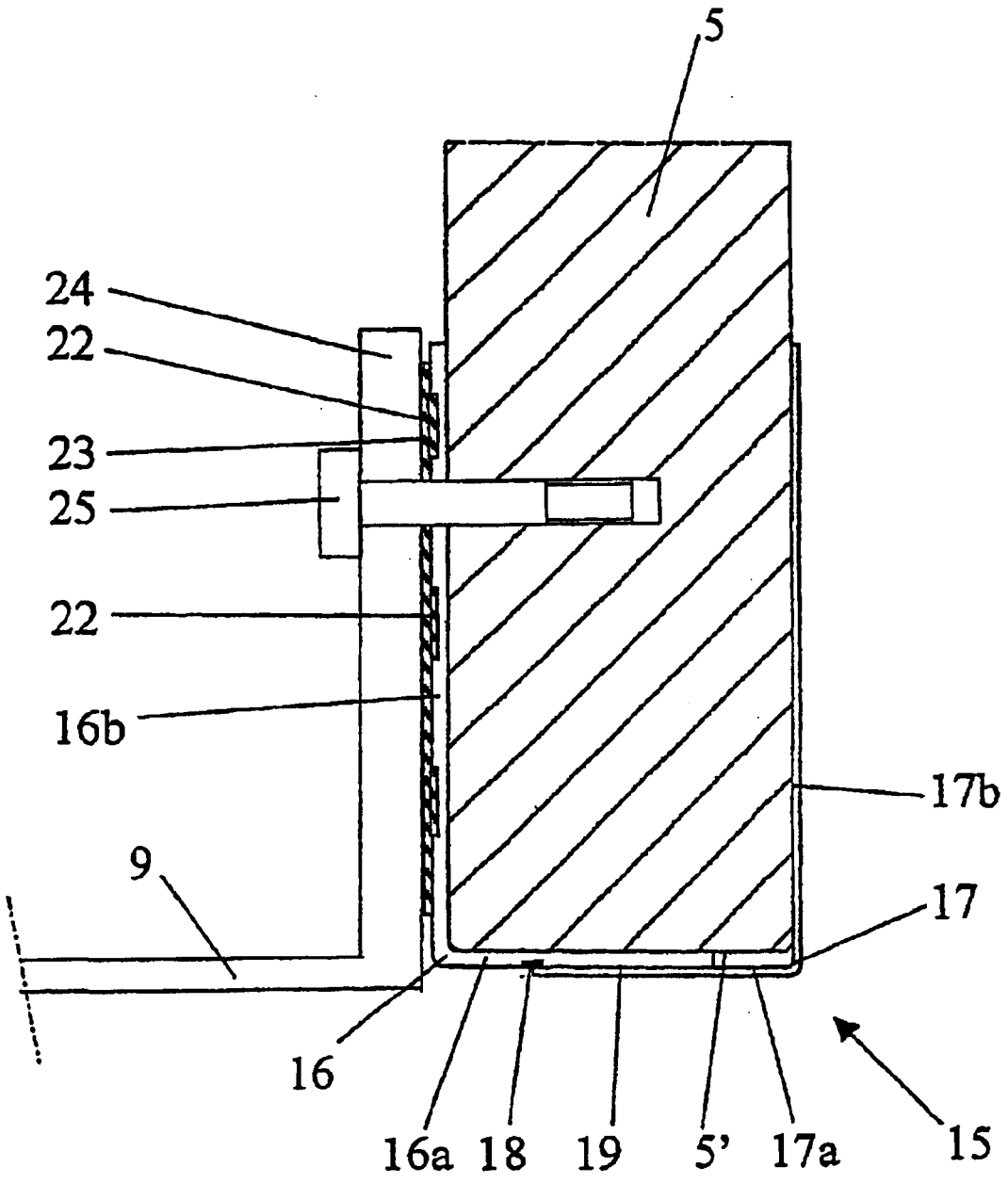
FIG. 2 discloses more closely, a sectional view of a porthole with a lining device of an end plate of the plate heat exchanger in FIG. 1.
Figure 3:
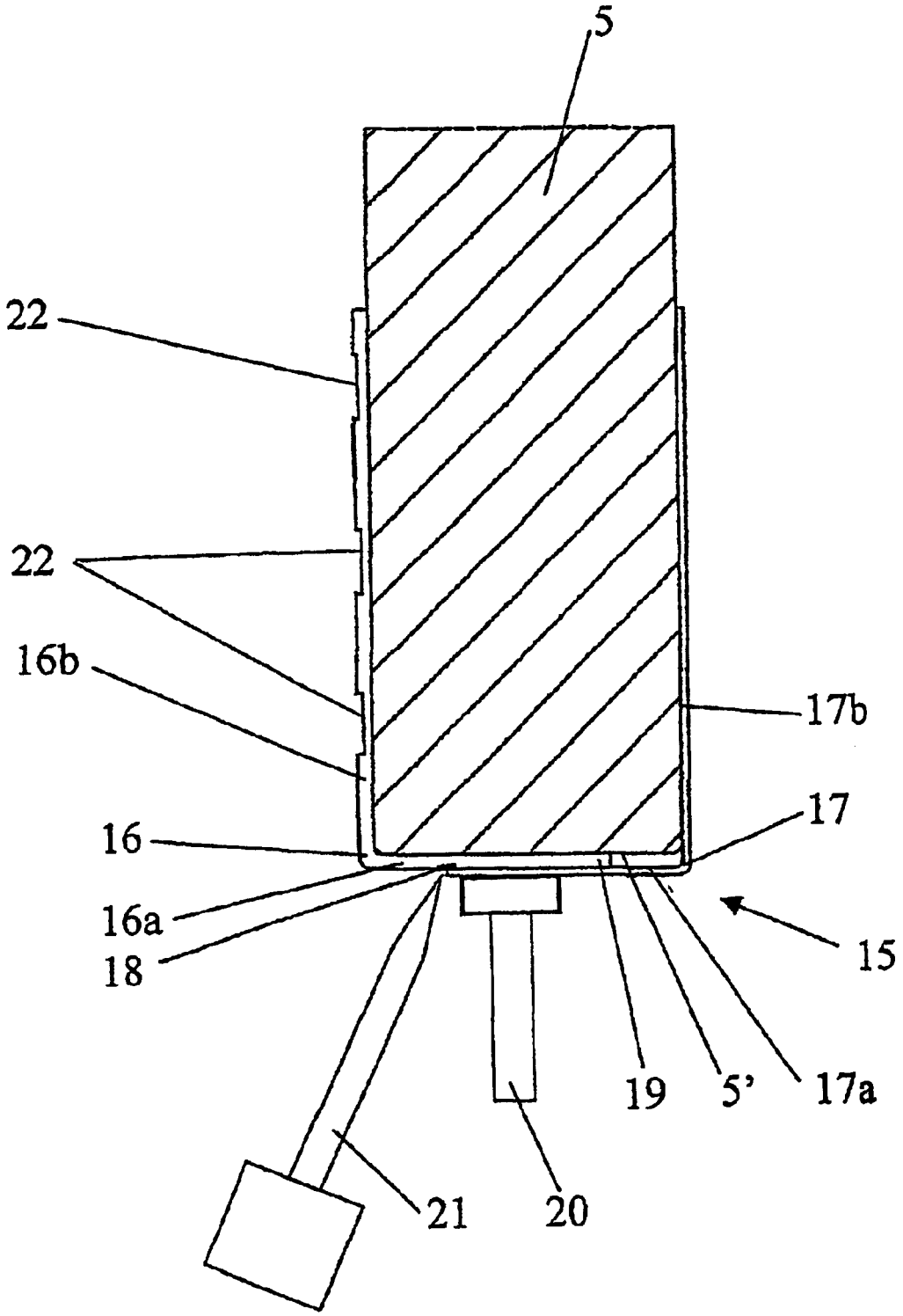
FIG. 3 discloses schematically how a weld joint is applied to the lining device.

In the portholes of the end plate 5, a lining device 15 is provided. The lining device 15 is disclosed more closely in FIGS. 2 and 3. The lining device includes a first outer part 16 and a second inner part 17. The two parts 16, 17 are connected to each other by means of a weld joint 18. The two parts 16, 17 include a respective substantially cylindrical pipe portion 16*a*, 17*a*, which extend into the porthole. Furthermore, both the parts 16, 17 include a respective abutment portion 16*b*, 17*b*, which extend around the respective pipe portion 16*a* and 17*a* and abut a respective surface of the end plate 5. In the embodiment disclosed, the abutment portions are shaped as flange portions 16*b*, 17*b*, which extend substantially radially outwardly from the respective pipe portion 16*a* and 17*a*. However, it is to be noted that these abutment portions also may have another shape. The outer abutment portion may for instance be shaped for connection to a pipe conduit or the like and include a thread, bayonet mounting etc. The flange portion 16*b* of the first part 16 thus abuts the outer side of the end plate 5 and the flange portion 17*b* of the second part 17 abuts the inner side of the end plate 5. Moreover, the pipe portion 16*a* of the first part abuts the surrounding limiting surface 5' of the porthole. The pipe portion 17*a* of the second part 17 has a somewhat smaller diameter than the pipe portion 16*a* and abuts, as appears from FIG. 2, the inner surface of the pipe portion 16*a*. Thus, an area 19 is formed in the porthole where the two pipe portions 16*a* and 17*a* overlap each other.

By means of the two parts 16 and 17, which are connected to each other by means of the weld joint 18, an effective lining of the end plate 5 is thus obtained in the area around the porthole. In such a way, the end plate 5, which may be manufactured of relatively simple carbon steel, may be protected from corrosive or heat transfer media which are aggressive in other ways. The two parts 16 and 17 are manufactured of a sheet metal of a higher quality and larger corrosion resistance than the end plate 5. The two parts 16 and 17 may for instance be manufactured of a substantially plane sheet metal which is deep-drawn for forming a respective pipe portion 16*a* and 16*b*. As appears from FIG. 2, the sheet metal of the first part 16 has a larger thickness than the second part 17. In the embodiment disclosed, both the flange portion 16*b* and the pipe portion 16*a* of the first part 16 have a larger material thickness than corresponding portions 17*a*, 17*b* of the second part 17. In the embodiment disclosed, the first part 16, with the larger material thickness, is arranged against the outer side of the plate heat exchanger whereas the second part 17, with the smaller material thickness, is arranged against the inner side of the plate heat exchanger, i.e. against the plate package. The first part 16 may have a material thickness which is larger than 1,5 mm and particularly larger than 2 mm, and preferably less than 8 mm whereas the second part 17 may have a material thickness which is at least 0,5 mm and at the most 3 mm, especially about 1 mm.

Furthermore, the pipe portion 17*a* of the second part is provided radially inside the pipe portion 16*a* of the first part 16 in the porthole. In such a way, it is permitted that the inner pipe portion 17*a*, during the manufacturing, is pressed against the radially outer pipe portion 16*a* in connection with the application of the weld joint 18. By such a pressing, which may be obtained by means of the pressing member 20, which is disclosed schematically in FIG. 3, air, and thus oxygen gas, may be pressed out of the area where the weld joint 18 is applied, i.e. in the embodiment disclosed at the outer end of the pipe portion 17*a*. Thanks to the larger material thickness of the radially outer pipe portion 16*a*, application of the relatively large pressing force to the radially inner pipe portion 17*a* is permitted. The weld joint 18 may be obtained in the embodiment disclosed by means of a TIG-welding device 21, which is indicated schematically in FIG. 3. The weld joint 18 is suitably applied at the outer end of the pipe portion 17*a* and more precisely at the transition between the pipe portion 16*a* and the pipe portion 17*a*. The weld joint 18 extends around substantially the whole porthole. The relatively large material thickness is also an advantage with regard to the application of the weld joint 18 since it reduces the risk of burning-through.

The flange portion 16*b* of the first part 16 also includes three milled grooves 22, which extend around the porthole. Outside the outer side of the flange portion 16*b*, a sealing element 23, for instance in the form of a gasket, is provided. Thanks to the grooves 22, the sealing element 23 may be pressed to a secure and tight abutment against the flange portion 16*b*. Outside the sealing element 23, a flange 24 of the pipe 9 is provided. The flange 24 abuts the sealing element 23 and is mounted to tight abutment by means of a number of bolts 25, which are screwed into the end plate 5 and provided around the porthole.

The invention is not limited to the embodiment disclosed but may be varied and modified within the scope of the following claims.

For instance, it is possible to provide the part, which faces the inner side of the plate heat exchanger, with the relatively thicker pipe portion and thus provide the part, which has the relatively thinner pipe portion, from the outer side of the plate heat exchanger and in such a way that this thinner pipe portion abuts the inner surface of the thicker pipe portion. The weld joint will then suitably be applied at the inner end of the pipe portion of the outer part.

In the embodiment disclosed, the flange portion 16*b* and the pipe portion 16*a* of the first part have the same material thickness, and the flange portion 17*b* and the pipe portion 17*a* of the second part also have the same material thickness. In such a way, the two parts may be manufactured in an easy manner. However, it is also possible to let the flange portion and the pipe portion of the respective parts have different thickness. For instance, the pipe portion 16*a* of the first part 16 may have a larger material thickness than the flange portion 16*b* of the first part 16.

What is claimed is:

1. A method for manufacturing a plate heat exchanger having a package of heat transfer plates and an end plate, the end plate having an outer side and an inner side facing the plate package and at least one porthole, wherein the method includes providing a first part manufactured of a sheet metal with a material thickness and having a substantially cylindrical pipe portion and an abutment portion, providing a second part manufactured of a sheet metal with a material thickness and having a substantially cylindrical pipe portion and an abutment portion, introducing the pipe portion of the first part into said porthole, introducing the pipe portion of the second part into said porthole and the pipe portion of the first part so that an area is formed where said pipe portions overlap each other, wherein the material thickness of the first part is greater than the material thickness of the second part at least in said overlapping area, and connecting the pipe portion of the second part to the pipe portion of the first part by the application of a weld joint.

2. A method according to claim 1, wherein the pipe portion of the second part is pressed against the pipe portion of the first part in connection with the application of the weld joint.

3. A method according to claim 1, wherein the weld joint is applied around substantially the whole pipe portion of the first part.

4. A method according to claim 1, wherein the pipe portion of the second part has a first end, which is introduced into the pipe portion of the first part, and wherein the weld joint is applied at said first end.

5. A method according to claim 1, wherein the weld joint is applied by a TIG-weld without any supply of material.

6. A lining device for a plate heat exchanger having a package of heat transfer plates (1) and an end plate (5, 6), said end plate having an outer side and an inner side facing the plate package and at least one porthole, wherein the lining device (15) comprises a first part (16) manufactured of a sheet metal with a material thickness and having a substantially cylindrical pipe portion (16*a*) and an abutment portion (16*b*), and a second part (17) manufactured of a sheet metal with a material thickness and having a substantially cylindrical pipe portion (17*a*) and an abutment portion (17*b*), the pipe portion (16*a*) of the first part being introducible in said porthole, and the pipe portion (17*a*) of the second part being introducible in said porthole into the pipe portion (16*a*) of the first part so that an area (19) is formed where said pipe portions overlap each other, and said first part (16) is connected to the second part (17) by a weld joint (18), wherein the material thickness of the first part (16) is greater than the material thickness of the second part (17) at least in said overlapping area (19).

7. A device according to claim 6, wherein the sheet metal of the first part (16) has a thickness which is greater than 1.5 mm at least at said overlapping area (19).

8. A device according to claim 6, wherein the weld joint (18) extends around substantially the whole pipe portion (16*a*) of the first part.

9. A device according to claim 6, wherein the pipe portion (17*a*) of the second part has a first end, which is introducible in the pipe portion (16*a*) of the first part, wherein the weld joint (18) is applied at said first end.

10. A device according to claim 6, wherein the abutment portion (16*b*) of one of the first part (16) and the second part (17) forms an outer abutment portion (17*b*) and abuts the outer side of the end plate (5), the abutment portion (17*b*) of one of the second part (17) and the first part (16) forms an inner abutment portion and abuts the inner side of the end plate (5), and the material thickness of the outer abutment portion is greater than the material thickness of the inner abutment portion.

11. A device according to claim 10, wherein the outer abutment portion (16*b*) has an outer side which faces away from the plate package and which includes at least one depression (22) for receiving a sealing element (23) between said outer side and a pipe connection (9, 24).

12. A device according to claim 6, wherein the pipe portion (16*a*) of the first part is introducible in said porthole from the outer side of the end plate (9), and the pipe portion (17*a*) of the second part is introducible in said porthole from the inner side of the end plate (5).

13. A device according to claim 6, wherein the abutment portion (16*b*) of the first part is shaped as a flange portion, which extends around the pipe portion and substantially radially outwardly from the pipe portion, and the abutment portion (17*b*) of the second part is shaped as a flange portion, which extends around the pipe portion and substantially radially outwardly from the pipe portion.

14. A plate heat exchanger comprising a package of heat transfer plates (1) and an end plate (5, 6), the end plate having an outer side and an inner side facing the plate package and at least one porthole, and a lining device (15), which is mounted at said porthole, wherein the lining device includes a first part (16) manufactured of a sheet metal with a material thickness and having a substantially cylindrical pipe portion (16*a*) and an abutment portion (16*b*), and a second part (17) manufactured of a sheet metal with a material thickness and having a substantially cylindrical pipe portion (17*a*) and an abutment portion (17*b*), the pipe portion (16*a*) of the first part being introducible in said porthole, and the pipe portion (17*a*) of the second part being introducible in said porthole into the pipe portion (16*a*) of the first part so that an area (19) is formed where said pipe portions overlap each other, and said second part (17) is connected to the first part (16) by a weld joint (18), wherein the material thickness of the first part (16) is greater than the material thickness of the second part (17) at least in said overlapping area (19).

15. A plate heat exchanger according to claim 14, wherein the abutment portion (16*b*) of one of the first part (16) and the second part (17) forms an outer abutment portion (17*b*) and abuts the outer side of the end plate (5), the abutment portion (17*b*) of one of the second part (17) and the first part (16) forms an inner abutment portion and abuts the inner side of the end plate (5), and the material thickness of the outer abutment portion is greater than the material thickness of the inner abutment portion.

* * * * *